US006570312B2

(12) United States Patent
Michalchuk et al.

(10) Patent No.: US 6,570,312 B2
(45) Date of Patent: May 27, 2003

(54) DAMPING SCRUBBER FOR A TENSION MASK SUPPORT FRAME

(75) Inventors: Joey John Michalchuk, Lambertville, NJ (US); Alan Weir Bucher, Manheim, PA (US)

(73) Assignee: Thomson Licensing S. A., Boulogne Cedex (FR)

( * ) Notice: Subject to any disclaimer, the term of this patent is extended or adjusted under 35 U.S.C. 154(b) by 73 days.

(21) Appl. No.: 09/950,865

(22) Filed: Sep. 12, 2001

(65) Prior Publication Data

US 2003/0048063 A1 Mar. 13, 2003

(51) Int. Cl.[7] ..... H01J 29/80; H01J 29/81

(52) U.S. Cl. ..... 313/407; 313/402; 313/404; 313/269

(58) Field of Search ..... 313/402, 403, 313/404, 405, 406, 407, 408, 269

(56) References Cited

U.S. PATENT DOCUMENTS 4,827,179 A * 5/1989 Adler et al. ..... 313/402
5,424,603 A * 6/1995 Van Den Bekerom ..... 313/407
6,509,679 B1 * 1/2003 Ligthart et al. ..... 313/407

* cited by examiner

*Primary Examiner*—Nimeshkumar D. Patel
*Assistant Examiner*—Karabi Guharay
(74) *Attorney, Agent, or Firm*—Joseph S. Tripoli; Joseph J. Laks; Carlos M. Herrera

(57) ABSTRACT

The invention provides a tension mask support frame assembly having a pair of support blade members attached to a frame. The support blade members are attached to opposite sides of the frame at a central location whereby each support blade member has a pair of distal ends extending from the central attachment point. A damping scrubber is disposed in the space between the support blade member and the frame near a distal end of the support blade members. Vibrations in the tension mask are thereby reduced through the transfer of the vibrations to the frame through rubbing action of the damping scrubbers.

8 Claims, 3 Drawing Sheets

DAMPING SCRUBBER FOR A TENSION MASK SUPPORT FRAME

FIELD OF THE INVENTION

This invention relates generally to cathode ray tubes and more particularly to tension mask support frame assemblies having a vibration damping scrubber on a support blade member which holds a tension mask.

BACKGROUND OF THE INVENTION

A color cathode ray tube, or CRT, includes an electron gun for forming and directing three electron beams to a screen of the tube. The screen is located on the inner surface of the faceplate panel of the tube and is made up of an array of elements of three different color-emitting phosphors. A shadow mask, which may be either a formed mask or a tension mask having strands, is located between the electron gun and the screen. The electron beams emitted from the electron gun pass through apertures in the shadow mask and strike the screen causing the phosphors to emit light so that an image is displayed on the viewing surface of the faceplate panel.

One type of CRT has a tension mask comprising a set of strands that are tensioned onto a mask support frame to reduce their propensity to vibrate at large amplitudes under external excitation. Such vibrations would cause gross electron beam misregister on the screen and would result in objectionable image anomalies to the viewer of the CRT.

One method of tensioning a mask utilizes a mask support frame having a pair of support blade members mounted on opposite sides of the frame parallel to the major axis of the CRT. The tension mask extends between the support blade members and is held in tension to reduce it's propensity to vibrate. A problem exists in that the support blade members supporting the mask are subject to vibration relative to the frame when external vibration is applied to the frame. Such external vibrations are then transferred to the tension mask.

SUMMARY OF THE INVENTION

The invention provides a tension mask support frame assembly for a CRT having a pair of support blade members attached to a frame. The support blade members are attached to opposite sides of the frame at a central location whereby each support blade member has a pair of distal ends extending from the central attachment point. A damping scrubber is disposed in the space between the support blade member and the frame near the support blade members' distal end. Vibrations in the support blade members are thereby reduced through rubbing action of the damping scrubbers against the frame. The fundamental frequency of vibration of the support blade member is also increased by having the distal ends of the blades touching the subframe.

BRIEF DESCRIPTION OF THE DRAWINGS

The invention will now be described by way of example with reference to the accompanying figures of which.

DETAILED DESCRIPTION OF THE INVENTION

Figure 1:
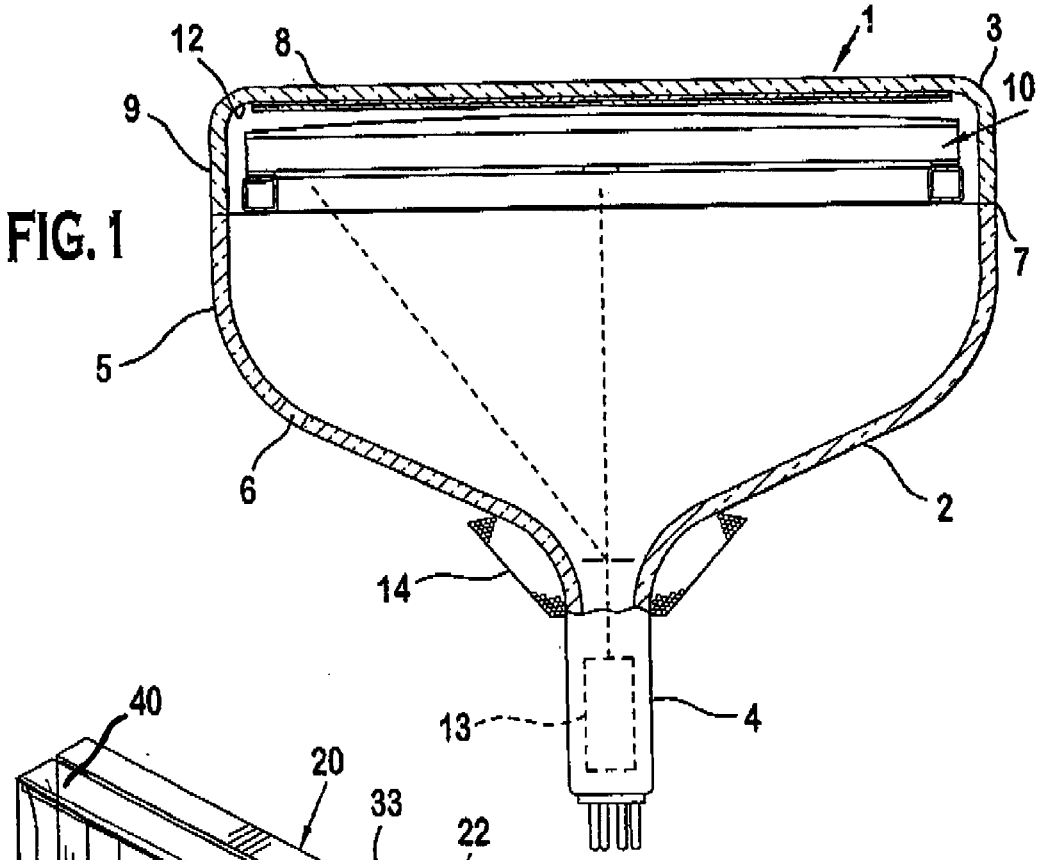
FIG. 1 is a cross sectional view of a CRT showing a tension mask support frame assembly.

FIG. 1 shows a cathode ray tube (CRT) 1 having a glass envelope 2 comprising a rectangular faceplate panel 3 and a tubular neck 4 connected by a funnel 5. The funnel 5 has an internal conductive coating (not shown) that extends from an anode button 6 toward the faceplate panel 3 and to the neck 4. The faceplate panel 3 comprises a viewing faceplate 8 and a peripheral flange or sidewall 9, which is sealed to the funnel 5 by a glass frit 7. A three-color phosphor screen 12 is carried by the inner surface of the faceplate panel 3. The screen 12 is a line screen with the phosphor lines arranged in triads, each of the triads including a phosphor line of each of the three colors. A tension mask support frame assembly 10 is removably mounted in predetermined spaced relation to the screen 12. An electron gun 13, shown schematically by dashed lines in FIG. 1, is centrally mounted within the neck 4 to generate and direct three inline electron beams, a center beam and two side or outer beams, along convergent paths through the tension mask support frame assembly 10 to the screen 12.

The CRT 1 is designed to be used with an external magnetic deflection yoke 14 shown in the neighborhood of the funnel-to-neck junction. When activated, the yoke 14 subjects the three beams to magnetic fields which cause the beams to scan horizontally and vertically in a rectangular raster over the screen 12.

Figure 2:
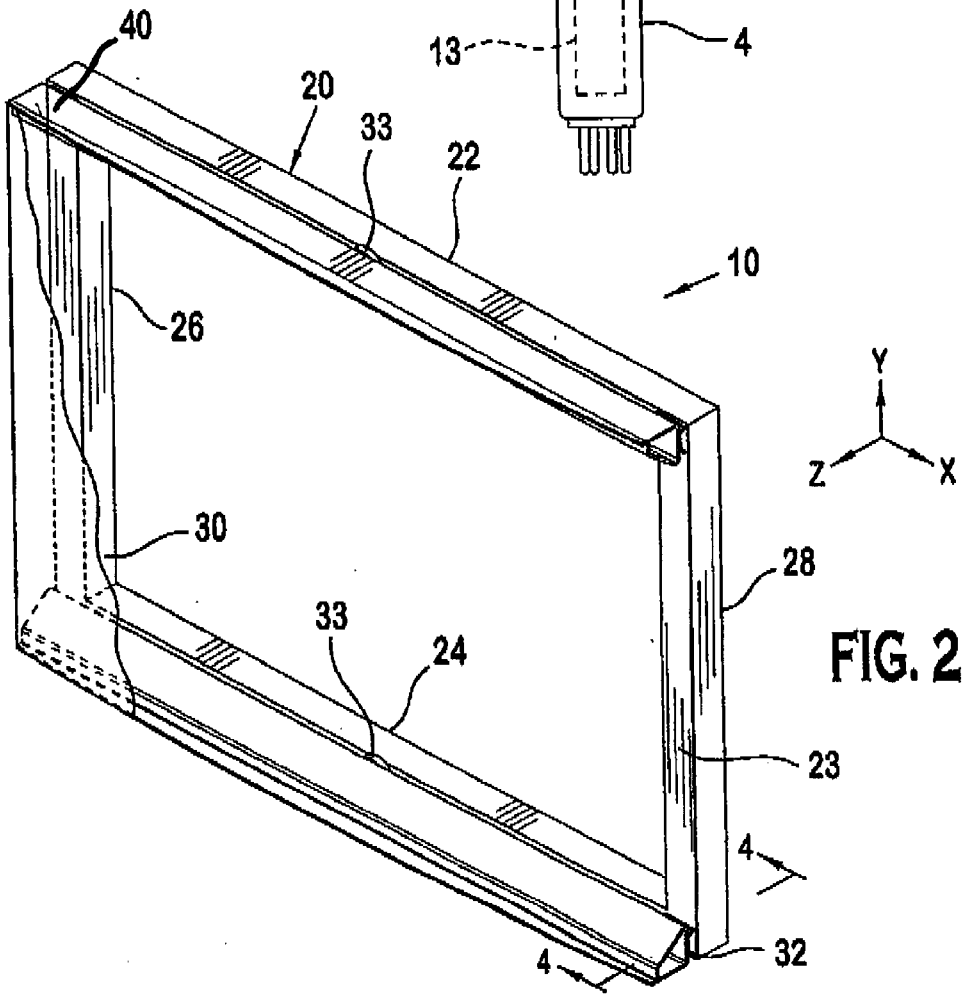
FIG. 2 is a perspective view of the tension mask support frame assembly.

The tension mask support frame assembly 10, as shown in FIG. 2, includes two long sides 22 and 24, and two short sides 26 and 28. The two long sides 22, 24 of the tension mask support frame assembly 10 are parallel to a central major axis, X, of the CRT; and the two short sides 26, 28 parallel a central minor axis, Y, of the tube. The two long sides 22, 24 and two short sides 26, 28 form a continuous planar mask support frame 20 along those major and minor axes. The frame 20 comprises an elongated wall portion 23 extending along the top peripheral surfaces of the long sides 22, 24 and short sides 26, 28.

The tension mask support frame assembly 10 includes a tension mask 30 (shown here diagrammatically as a sheet for simplicity) that contains a plurality of metal strips (not shown) having a multiplicity of elongated slits (not shown) therebetween that parallel the minor axis, Y, of the tube. The tension mask 30 is fixed to a pair of support blade members 40 which are fastened to the frame 20 at mounting locations 33. The support blade members 40 may vary in height from the center of each support blade member 40 longitudinally to the ends of the support blade member 40 to permit the best curvature and tension compliance over the tension mask 30.

Figure 3:
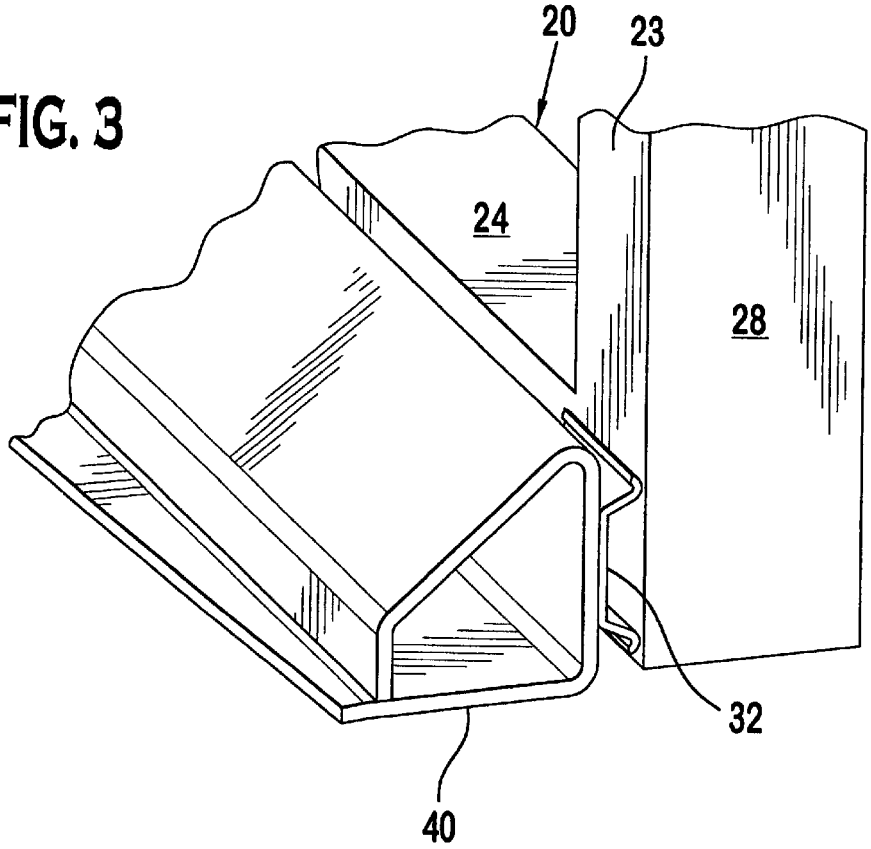
FIG. 3 is a partial perspective view of an end of the tension mask support frame assembly.
Figure 4:
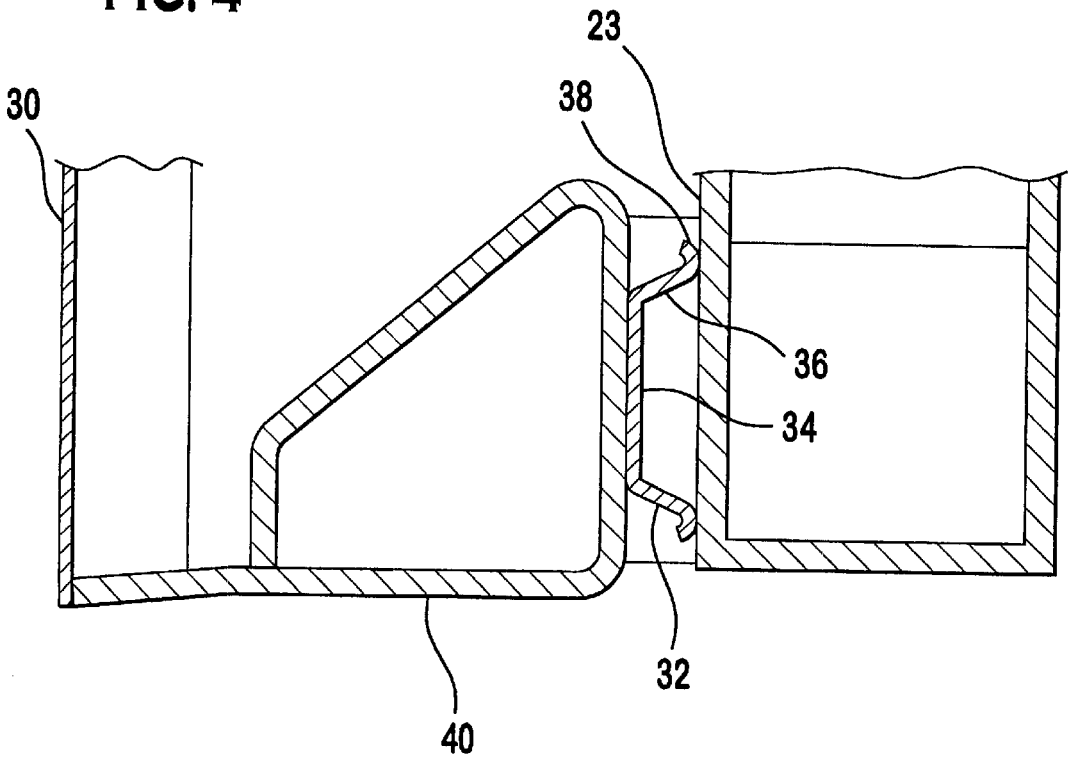
FIG. 4 is a cross sectional view taken along the line 4—4 of FIG. 2.

Referring now to FIGS. 3 and 4 the damping scrubber 32 is attached on the bottom of the support blade member 40 near its distal end. The damping scrubber 32 is best shown in FIG. 3 as being positioned against the elongated wall portion 23 of the frame 20. As best shown in FIG. 4, the damping scrubber 32 has a central 10 portion 34 and a pair of resilient legs 36 extending therefrom. The resilient legs 36 extend from the central portion 34 at an angle toward the wall portion 23 and include curled sections 38 formed at their free ends. The central portion 34 is attached to the bottom surface of the support blade member 40 by welding or any other suitable means such as a high temperature adhesive. It should be understood that the central portion 34 of the damping scrubber 32 may alternatively be attached either to the support blade member 40 or to the frame 20. The damping scrubber 32 is positioned between the support blade member 40 and frame 20 such that the curled sections 38 are in scrubbing or frictional contact with the wall portion 23 and the resilient legs 36 are preloaded and flexed against the wall portion 23. During vibrations, these curled sections 38 scrub against the wall portion 23 to dampen the vibration imparted to the frame 20 which tend to deflect the distal ends of the support blade member 40 and thereby reduce the duration of vibrations of the tension mask 30. The resilient legs 36 ensure contact, and thus friction, and provide a force that raises the resonance of the support blade member 40. Such increase in resonance reduces the amplitudes of motion by separating them from other natural frequencies of the mask-frame assembly.

An advantage of the present invention is that, the resilient legs 36 flex closer together and further apart cyclically as the frame 20 and support blade member 40 move away and towards one another respectively. These flexures cause the resilient legs 36 to rub against the frame 20 with each cycle of motion to dampen the effects of vibration on the support blade member 40 thus shortening their duration.

Figure 5:
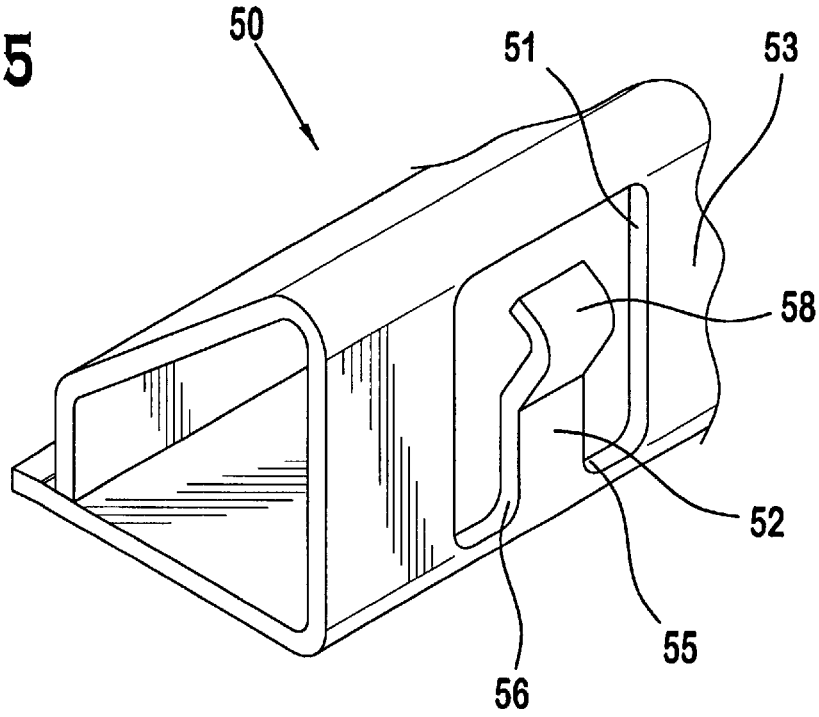
FIG. 5 shows an alternative embodiment of the tension mask support frame assembly and damping scrubber of FIG. 2.

FIG. 5 shows an alternate embodiment of the support blade member 50. In this support blade member 50 an opening 51 is formed along a frame facing wall 53. An integral damping scrubber 52 extends from the frame facing wall 53 into the opening 51. The damping scrubber 52 consists of a resilient leg 56 extending into the opening 51 from an attachment end 55 having a curled section 58 disposed at a free end. The resilient leg 56 is preloaded outward from the frame facing wall 53 such that when installed, it resiliently engages the wall portion 23 of the frame 20. The contact of the resilient leg 56 against the wall portion 23 similarly dampens the vibration imparted to the frame 20 thereby reducing the vibration on the tension mask 30.

The resiliency of the resilient leg 56 may be adjusted by adding features to its attachment end 55, for example the material of the resilient leg 56 may be thinned at the attachment end 55 or edges of the attachment end 55 may be coined to provide varying degrees of resiliency. These features may act as a hinge to cantilever the resilient leg 56 at various levels of resiliency. While the resilient leg 56 is shown here as being preferably integral with the frame facing wall 53, the leg may be attached to the frame by other suitable means and extend into the frame opening 51 as shown in FIG. 5.

Figure 6:
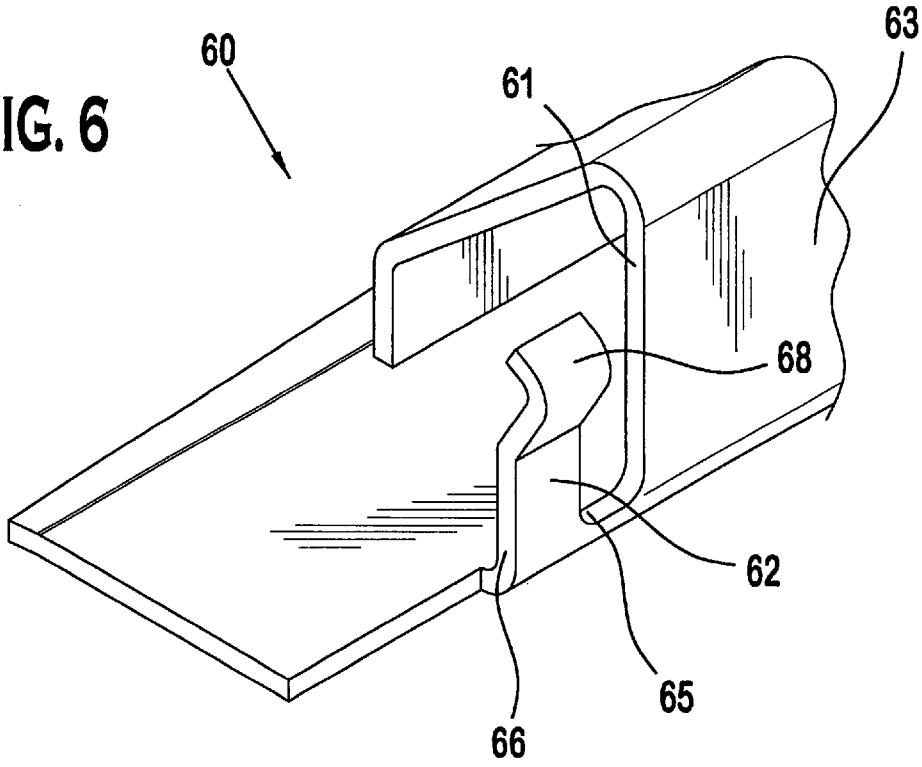
FIG. 6 is another alternate embodiment tension mask support frame assembly of FIG. 5.

In another alternate embodiment as shown in FIG. 6, the resilient leg 66 may be attached at the distal end of the support blade member 60 instead of extending into an opening along the frame facing wall. This resilient leg 66 is otherwise similar to the resilient leg 56.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A tension mask support frame assembly for a CRT comprising:

a substantially rectangular frame including a central major axis and a central minor axis perpendicular to each other, the frame having a pair of opposing long sides extending in parallel to the major axis and a pair of opposing short sides extending in parallel to the minor axis;

a tension mask supported on a support blade member attached to the frame at an attachment point along a pair of the opposing sides; and, a damping scrubber being positioned between the support blade member and the frame.

2. The tension mask support frame assembly of claim 1 wherein the damping scrubber further comprises a central portion attached to the support blade member near a distal end thereof.

3. The tension mask support frame assembly of claim 2 wherein the damping scrubber further comprises a pair of legs extending at an angle from the central portion.

4. The tension mask support frame assembly of claim 3 wherein the damping scrubber further comprises a pair of curled ends positioned at free ends of each leg.

5. The tension mask support frame assembly of claim 4 wherein the legs are preloaded against the frame.

6. A damping scrubber for use in a tension mask support frame assembly of a CRT including a pair of support blade members attached to a frame, comprising:

a resilient leg extending from the blade members and having a free end in scrubbing contact with the frame whereby the resilient leg dampens vibration imparted to the frame.

7. The damping scrubber of claim 6 wherein the resilient leg extends from the support blade member toward the frame such that the resilient leg is preloaded between the support blade member and the frame.

8. The damping scrubber of claim 6 wherein the resilient leg includes a curled section extending from the free end of the resilient leg such that the curled section is in scrubbing contact with the frame.

* * * * *